United States Patent [19]

Gammell

[11] 4,098,303

[45] Jul. 4, 1978

[54] VAPOR RECOVERY SYSTEM FOR LOADING BACKS AND STORAGE TANKS

[75] Inventor: Donald M. Gammell, Arcadia, Calif.

[73] Assignee: Robert Brown Associates, Carson, Calif.

[21] Appl. No.: 724,332

[22] Filed: Sep. 17, 1976

[51] Int. Cl.[2] ..... B65B 31/00

[52] U.S. Cl. ..... 141/52; 55/88; 141/70; 141/83; 141/94; 141/192; 220/85 VR

[58] Field of Search ..... 55/26, 32, 53, 88; 141/44, 45, 52, 59, 290, 392, 11, 69, 70, 83, 94, 192; 73/27 A, 1 G; 220/85 VR, 85 VS

[56] References Cited

U.S. PATENT DOCUMENTS

| | | | |
|---|---|---|---|
| 3,753,453 | 8/1973 | Madden et al. | 141/290 X |
| 3,783,911 | 1/1974 | Husa et al. | 141/11 |
| 3,830,040 | 8/1974 | Hendrix | 55/32 |

*Primary Examiner*—Richard E. Aegerter
*Assistant Examiner*—Frederick R. Schmidt
*Attorney, Agent, or Firm*—Sellers and Brace

[57] ABSTRACT

A vapor recovery system for closed volatile liquid storage facilities including loading rack systems for tank trucks, rail cars, ship and barge cargo compartments. These facilities have provision for charging the system with blanketing gas under controlled pressure conditions for admixture with vapor of the volatile liquid. This mixture is processed for recovery of the vapor and gas constituents under the supervision and control of precision oxygen monitoring. Whenever the detected percentage of oxygen exceeds a predetermined safe value, corrective measures are taken immediately and automatically and acknowledging devices are activated and additional blanketing gas may be supplied to decrease the percentage of oxygen in the facility. Vapor and gas mixtures monitored and found safely non-combustible are processed by compression and heat exchange to condense some of the vapor and to elevate the pressure level. Vapor and blanketing gas is conducted from sweet and/or sour liquid storage tanks into a holding tank before being processed for recovery of the gas and vapor, whereas vapor and blanket purge gas originating from loading rack facilities bypasses the holding tank and flows directly to compressing and condensing components. Portions of the vapor not condensed remain in the gas and vapor mixture at pressures where they can be beneficially utilized. If the blanket gas is combustible, such as natural gas from a gas utility, the net exhalations may be used as a general purpose fuel gas or returned to the gas utility. The system includes automatic equipment safeguarding against contamination of sweet liquid by vapor from sour liquid sources.

38 Claims, 1 Drawing Figure

VAPOR RECOVERY SYSTEM FOR LOADING BACKS AND STORAGE TANKS

Figure 1:
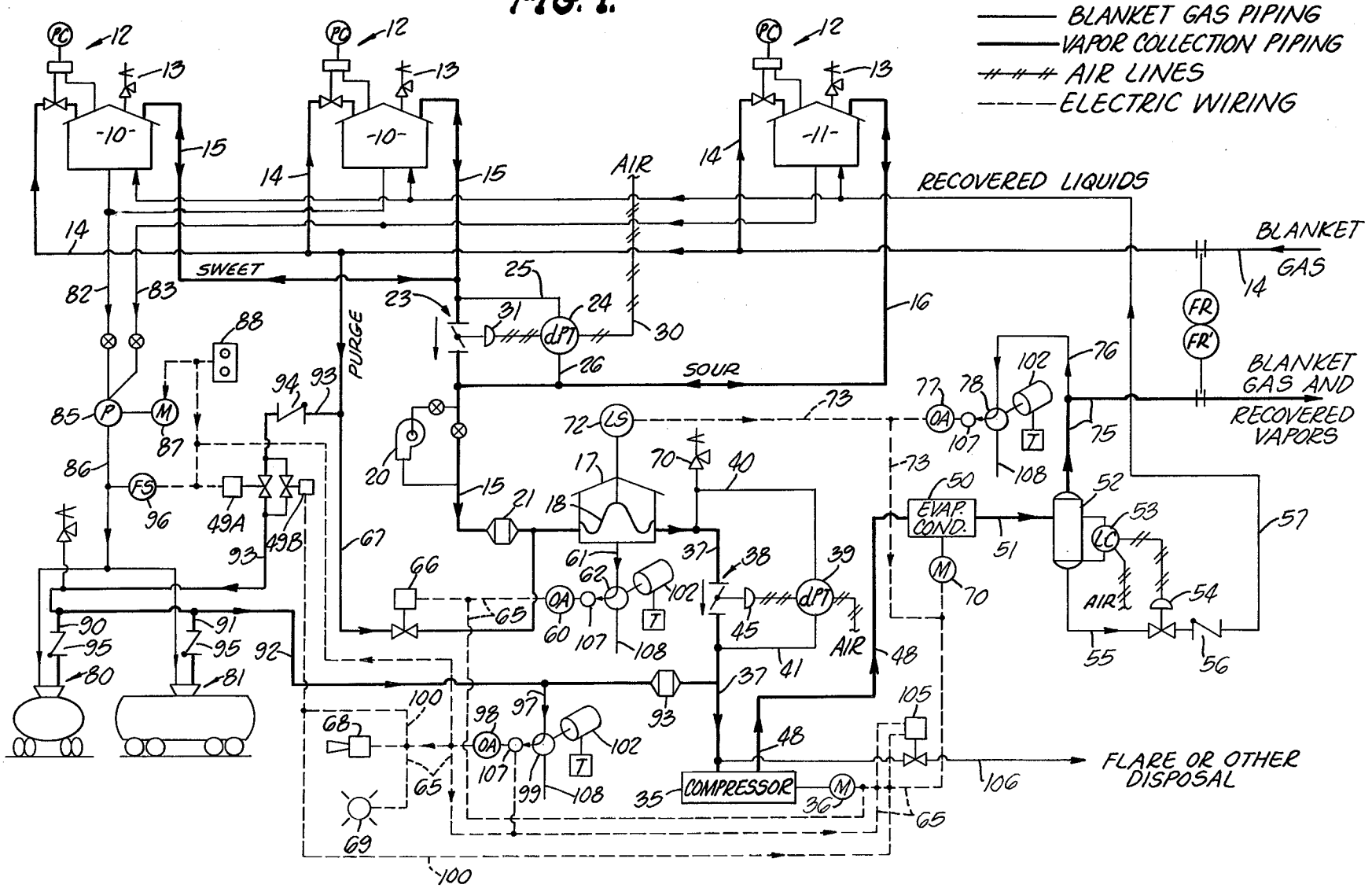

This invention relates to equipment for recovering volatile petroleum vapors, and more particularly to a closed petroleum storage facility the ullage of which is charged with a blanketing gas under accurately controlled pressure conditions together with means for monitoring the system for small quantities of oxygen before being admitted to vapor recovery equipment. The system features high precision self-checking oxygen analyzers for detecting incipient hazardous conditions and for operating control devices to maintain wide-margin safe operating conditions under widely varying operating and atmospheric conditions.

BACKGROUND OF THE INVENTION

Persons constructing and operating facilities for handling volatile liquids and petroleum products and derivatives thereof are confronted with difficult and challenging problems as respects the control of portions of these products in vapor phase. Such vapors are fugitive and commonly escape to the atmosphere in quantities presenting economic losses and series hazards to the health of humans, animals and plant life. Private and commercial interests have made earnest and costly efforts to minimize these vapor emissions and hazards but the complexities of the problems to be dealt with and the costs involved present obstacles which have not been satisfactorily resolved heretofore. In recent years governmental agencies have endeavored to establish strnginet standards butressed with stiff penalties. Despite these incentives and the diligent efforts of many designers in providing a wide variety of modes of dealing with the problems no satisfactory protective system has yet been devisedmeeting current requirements.

The following patents are typical of the vapor treating and recovery system heretofore proposed, namely, Hartman U.S. Pat. No. 2,765,872, Moragne, U.S. Pat. No. 3,266,262, Bragg U.S. Pat. No. 3,590,559, Battey U.S. Pat. No. 3,714,790, Husa, U.S. Pat. No. 3,783,911, Schonewald U.S. Pat. No. 3,648,436, David, U.S. Pat. No. 3,672,180, Henrix U.S. Pat. No. 3,830,040, McNamee U.S. Pat. No. 3,886,759, and Mair U.S. Pat. No. 3,903,078. These systems are either totally lacking or have inadequate means for preventing the occurrence of flammable mixtures in the recovery system and, in consequence, are subject to hazardous operating conditions. Only Husa U.S. Pat. No. 3,783,911 and McNamee U.S. Pat. No. 3,886,759 utilize oxygen analyzers to monitor vapor for the presence of oxygen but each of these teachings lacks suitable means for utilizing the analyzer to provide protection against flammable vapor conditions. Some prior vapor recovery systems are said to operate with a reasonable degree of satisfaction under limited ambient temperature conditions as, for example, a temperature range of 70°-80° F, but provide unacceptable and unsatisfactory results under commonly encountered higher ambient temperatures, such as 85°-120° F.

Among the vapor control expedients currently in use are those utilizing floating roofs with seals between the roof rims and the interior tank walls. These systems are costly, difficult to maintain, subject to varying vapor emissions under varying structural and atmospheric conditions, which losses are extremely difficult to measure with any degree of accuracy. They also fail to meet the continually more stringent standards promulgated by governmental environment agencies. A predominant cause of vapor leaks from floating roof seals is the out-of-roundness of the tank shell. Such distortions develop over a period of time with earth movements under the tank. Ambient weather conditions also tend to deteriorate the effectiveness of the working floating roof seal.

Closed vapor recovery systems, on the other hand, using a blanketing gas under fixed tank roofs have no working seals, and 100% of liquid vapor emissions are normally recovered. Prior to this invention such systems have been hazardous for lack of any reliable provision to safeguard against explosive conditions owing to the possible entry of oxygen into the system under various operating conditions. Ignition of such combustible gas mixtures can occur from numerous sources, such as electrostatic conditions caused by fluid movements within the storage tanks, tank gauging operations, or the presence of pyrophoric iron sulfide, and others. Also, liquid contaminations have occurred between tankages in a closed system, and constant operator attention has been necessary. Commercial vapor recovery packages commonly are designed for truck loading rack vapors exclusively and use higher compression ratios, sometimes to auto-ignition pressures, refrigeration with attendant icing problems, and/or absorption with up to 10% of the collected vapors being wasted in order to dispose of that which does not absorb.

SUMMARY OF THE INVENTION

This invention avoids the numerous shortcomings and disadvantages of prior proposals for safeguarding volatile fluids against vapor losses and combustible mixtures, utilizing fully closed storage and volatile liquid loading systems which are substantially fully automatic and as efficacious as it is reliable and safe. The system has general application to all volatile liquids, and more particularly to the storage and loading of petroleum liquids. Recovery of substantially all vapors from these liquids is assured under conditions which have provided at least a ten-fold safety factor for petroleum storage facilities and a three-fold safety factor for the operation of loading rack facilities. The difference is due to the normal absence of oxygen in the vapor recovery system of storage facilities.

The invention system may include any number of gas-blanketed storage tanks for as many different kinds of volatile liquids each typically equipped with an air-liquid conical roof as well as loading rack facilities for trucks, rail cars, ships and barges, all connected to and forming part of a closed vapor recovery system. The closed blanketing system includesa gas holding tank and suitable means for separating out condensed vapors while retaining the remainder captive and mixed with the combustible blanketing gas. This mixture is then utilizable beneficially either on the premises or disposed of for heating value to the utility supplying the blanketing gas. An inert or non-combustible blanketinggas may also be used in those instances where a combustible gas is not economically available. A suitable inert gas may be carbon dioxide, nitrogen, flue gases, etc., as long as it is not detrimental to the liquids being handled or to the mechanisms involved. The vapor condensing equipment typically comprises a compressor, evaportive condenser, and a liquid separator. Strategic portions of the blanketoing system are equipped with high sensitivity oxygen analyzer recording controllers for dtermining the presence of even minute quantities of oxygen together with means responsive to detection of such oxygen to operate automatic controls to rectify the problem as well as warning devices for supervisory personnel. Each analyzer is preferably of the type which periodically checks itself for accuracy and sounds an alarm if not in a fully satisfactory operating condition or in need of servicing.

The liquid storage tanks include sensitive valve control means for isolating the liquid storage tanks from contamination by incompatible vapor from one or more other liquid storage tanks, yet permitting the vapor emanating from all tanks to be processed for recovery by the same recovery facilities. For example, one group of tanks may contain sweet liquid and other s sour liquid. Vapor recovered from the loading rack is also processed by the same compressor and condenser facilities but separately from the holding tank for vapor recovered from the storage facilities. If the oxygen analyzers monitoring the gas holder and the holding racks detect an abnormal quantity of oxygen, controls activated by these analyzers operate to discontinue operation of the compressor and condenser and to purge additional blanketing gas. Uncondensed vapor and blanketing gas mixtures have a higher heating value than that of the blanket gas alone. Net exhalations from this invention, therefore, are a better fuel gas per unit volume than the blanket gas, and the valumes exhaled from the invention are greater than those inhaled into it. When the blanket gas is combustible, it may be used as a fuel gas on the premises or sold as such to others. When the blanket gas is non-combustible, net exhalations are flared, or otherwise disposed of safely. "Sour" is meant herein to identify any volatile liquid whose vapors are detrimental in any way to another volatile liquid, identified as "sweet", "Ullage" as used herein is the total volume of the storage tank less the stored liquid volume. "Margin of safety" as used herein means the concentration of oxygen measured divided by the minimum concentration of oxygen required to support combustion.

Accordingly, it is a primary object of this invention to provide a unique and improved vapor recovery system for recovering all vapor emissions occurring in or produced by volatile liquid storage and loading facilities.

Anotherobject of the invention is the provision of a closed vapor recovery system for volatile liquid loading vacilities maintained charged with an inert or a combustible blanket purge gas, and including vapor recovery facilities, the operation of which is monitored and automatically stopped and restarted by oxygen analyzer means, depending upon the presence or absence of oxygen as respects a predetermined percentage of oxygen, without need for interrupting the loading operation.

Another object of the invention is the provision of a fully closed vapor recovery system for volatile hydrocarbon storage facilities wherein portions of the facilities not filled with liquid are chargeable with inert or combustible blanketing gas, including means for monitoring this gas for the presence of oxygen, and including means for condensing portions of the volatile vapor present therein and for routing the remainder of the combustible vapor and gas mixture to a place of beneficial usage therefor.

Another object of the invention is the provision of volatile liquid handling facilities including bulk storage tanks and loading rack facilities for rail cars, trucks, ships, and barges, all connected in a gas blanketing vapor recovery system continually monitored and controlled by oxygen analyzer means.

Another object of the inventin is the provision of a fully cosed vapor recovery system for hydrocarbon storage and handling facilities havinga combustible blanketing gas admitted to the ullage thereof, and to the loading rack vapor collection header, from a public utility, and wherein said blanketing gas plus collected hydrcarbon vapor is returned to the utility after saidvapor and gas mixture has been analyzed and found not to contain harmful contaminents.

Anogther object of the invention is the provision of loading racks with conventional vapor recovery nozzles for tracks, rail cars, ships and barges connected to a closed vapor recovery system automatically supplied with a blanket gas purge during the liquid transfer to such vehicle compartments and which vapor recovery system is monitored by an oxygen analyzer automatically operable to discontinue vapor recovery and to route the gas and vapor mixture to a safe point of disposal upon detection of a predetermined concentration of oxygen therein, and to resume vapor recovery operation as soon as the excess oxygen condition has been rectified, all without interrupting the liquid loading operations.

Another object of the invention is the provision of volatile liquid storage facilities including separate storage tanks for non-compatible volatile liquids in a closed vapor recovery circuit charged with blanketing gas and including valve means for automatically isolatong one or more liquid storage tank from contamination by vapor emanating from another storage tank or tanks.

These and other more specific objects will appear upon reading the following specification and claims and upon considering in connection therewith the attached drawing to which they relate.

Referring now to the drawing in which a preferred embodiment of the invention is illustrated:

FIG. 1 is a diagrammatic showing of an illustrative embodiment of a closed vapor recovery system for a volatile liquid storage and loading facility incorporating the principles of this invention.

VAPOR RECOVERY FROM STORAGE FACILITIES

Referring to FIG. 1 there is shown a par of sweet volatile liquid storage tanks 10,10 and a sour volatile liquid storage tank 11. It will be understood that these three tanks are merely illustrative and that a typical storage facility may and usually includes a larger number of storage tanks. Each tank has a fluid-tight cone roof conventionally 3/16 inch thick provided with an automatic pressure control valve 12 for controlling the admission of blanketing gas into the associated tank and a pressure-vacuum relief valve 13 typically adjusted to vent to the atmosphere if the internal pressure exceeds 0.50 osi and to admit air if the internal pressure is below the ambient pressure by 0.50 osi. Relief valves 13 only open upon emergency to prevent structural damage to the fixed roof tanks.

The pressure control valves 12 are of conventional construction having a diaphragm one side of which is subject to the pressure within the tank and the other side to atmospheric pressure and effective to open and close a valve admitting blanketing gas to the tank ullage preferably supplied from a blanketing gas supply, such as a public gas utility distribution system, or a supply of inert gas if combustible gas is not available. This gas is distributed to the tank ullage from piping 14 through pressure control valve 12. The ullage pressure is maintained above 0.25 osi vacuum by blanketing gas admitted by pressure control valve 12, thereby preventing relief valve 13 from admitting air into the tank.

The ullage of each of the storage tanks 10,11 is connected by piping 15,16 to a gas holding tank 17 equipped with a flexible diaphragm 18. This diaphragm is supported by the captive mixture of vapor and blanketing gas and has a weight, such as 0.2 osi, selected to maintain the captive gas in the gas holder at that pressure. In consequence, the slightly higher pressure available in the ullage of the storage tanks is effective to provide an exhalation of vapor and blanketing gas into the gas holding tank 17. If the physical arrangements of tankage piping and the stored liquid volatilities combine to produce pressure drops which cause the pressure-vacuum relief valves 13 to release vapor or gas to the atmosphere, it is necessary that piping 15 be enlarged and/or provided with a motor driven blower 20 for aiding or augmenting gas flow. Alternatively, a greater storage tank pressure can be tolerated by increasing the weight and strength of the roof, and increasing the pressure-relieving set point of valve 13. Piping 15 is provided with a flame arrester 21 in order to prevent any flame that should occur at the gas holder from propagating to tanks 10 or 11.

If the described totally closed vapor recovery system includes one or more volatile liquid storage tanks which contain vapors which are detrimental to the liquid contents of the other tanks, such as those vapors from tank 11, piping 15,16 is provided with differential pressure responsive valve means to prevent the movement of vapor therefrom into the liquid storage tanks 10. Suitable automatic valving for this purpose includes a normally closed butterfly valve 23 in piping 15. This valve remains closed until the pressure on the inlet side of the valve exceeds the pressure on the outlet side. When the inlet pressure in piping 15 exceeds the pressure in piping 16, a sensitive pressure transmitter 24 functions in a manner well known to those skilled in the differential pressure valve art to open valve 23 widely. Differential pressure transmitter 24 is connected by conduit 25 to the upstream side of piping 15 and the other side of which is connected by a conduit 26 to piping 16. A supply of air pressure is transmitted from 24 to the diaphragm of valve 23 to positively actuate the butterfly valve position under the control of the differential pressure transmitter 24.

To permit return of the vapor and gas mixture to a fuel gas supply system, it is necessary to raise the pressure of this mixture to the system pressure, such as 40 psi for a refinery fuel gas system. Herein this is accomplished by a compressor 35 driven by motor 36. The heat of compression is removed most effectively by an evaporative condenser 50, the water of which is circulated by pumps powered by motor 70. The vapor and gas mixture is conducted to the intake of compressor 35 via piping 37 which is equipped with a butterfly valve 38. This valve operates in the same manner as valve 23 and is controlled by a pressure differential transmitter 39 connected to piping 37 on the opposite sides of valve 38 via conduits 40,41. If the pressure on the inlet side of valve 38 exceeds that on the outlet side very slightly, transmitter 39 operates to open valve 38 widely with supply air pressure.

The purpose and function of differential pressure responsive valve 38 is to prevent the vapors collected from the loading rack facilities from entering the gas holding tank 17. The gas mixture from the loading rack may contain oxygen in varying amounts while that from tankage should contain no oxygen. The presence of valve 38 assures that oxygen analyzer 60 is monitoring exhalations from tankage only. Thus, it can cause an alarm and a flow of blanket gas purge through solenoid valve 66 when only as little as one tenth of the oxygen concentration is detected that is required for combustion. If the oxygen concentration increases, nevertheless, to one third of that required for combustion, oxygen analyzer 60 will cause vapor recovery compressor 35 and evaporative condenser 50 to stop by de-energizing their respective motors 36 and 70. Such will be described in greater detail presently.

Vapor and blanketing gas compressed in compressor 35 exits through piping 48 and enters the evaporative condenser 50 where the heat of compression is removed and some condensation may occur. The fluid then passes via pipe 51 into the separator 52. When the liquid level reaches a predetermined height in separator 52, level controller 53 pneumatically opens valve 54, allowing the liquid to exit through pipe 55. check valve 56, and through pipe 57 back to any selected one of the liquid storage tanks 10, or to some other storage tank. All of the blanketing gas and the non-condensed vapor, or net exhalations, exits from the vapor recovery system via piping 75. This gas and vapor mixture from piping 75 is a high heating value fuel gas utilizable as such in any of many ways.

A critically important feature of the invention vapor recovery system involves the safeguards and equipment employed to prevent the accumulation of dangerous quantities of oxygen in the vapor recovery system. Such protection is provided by three high precision oxygen analyzers each connected to a particular part of the vapor recovery system as will now be described.

A first one of these oxygen analyzers 60 is connected to the gas holding tank 17 via a sampling connection 61 and a threeway valve 62 normally postioned as shown to supply a sample of vapor and gas to analyzer 60. A suitable high-precision oxygen analyzer found to provide most reliable and satisfactory results is obtainable commercially from Teledyne Corporation and is designated by that manufacturer as TAI Model 326B-2X. This analyzer contains an oxygen detector cell having a porous diaphragm exposed to the flow of the gas to be analyzed and functions to provide an electrical D.C. output signal having a voltage level varying linearly with the amount of oxygen present in the gas being analyzed. This output signal is utilized to govern the operation of electrical control circuitry in a manner well known to those skilled in the control art to operate relay circuits governing power supplies to one or more alarms, warning devices and control auxiliaries for the vapor recovery system. Thus when analyzer 60 detects a low concentration of oxygen present in gas holder 17, such as 1.7 volume percent, representative of a ten fold factor of safety before reaching the upper explosive limit of this gas and vapor mixture, the resulting output signal provided by the analyzer is transmitted through control relays over electrical connections 65 to open the normally closed solenoid valve 66 to admit purging blanketing gas via piping 67 to the gas and vapor mixture entering the gas holder. Concurrently, it will sound an alarm (not shown) to acknowledge the attendant that this mitigating action is taking place. If the oxygen concentration increases further to 5.7 volume percent, or one third of the aforementioned margin of safety, the associated higher voltage output signal is utilized to operate power control relays to shut off motor 36 driving compressor 35 and motor 70 circulating water through evaporative condenser 50, and to sound a separate alarm (not shown) to advise operating personnel that such is occurring.

A variable volume gas holder is provided so that the compressor and evaporative condenser need not operate continuously, but only to empty the holder as far as tankage is concerned. When the gas holder diaphragm is about 80% full, its level sensing switch 72 starts the compressor and condenser. Surplus holder volume is provided for the special case where net tank exhalations into the holder plus loading rack vapors exceed the compressor capacity. When the holder is evacuated and the diaphragm drops to a low level, the level switch 72 stops the compressor and condenser unless the loading rack is in operation.

The additional blanketing gas purged into the gas holder via solenoid valve 66 and supply piping 67 decreases the concentration of oxygen present in gas holder 17. If so much blanket purge gas is admitted to the gas holder diaphragm that it reaches its maximum capacity before the oxygen concentration is adequately reduced, and in spite of the compressor being in operation, the gas pressure will then rise to a predetermined maximum value, such as 0.5 osi, whereupon a pressure relief valve 70 connected to the gas holder, as via pipe 40, opens and wastes gas to the atmosphere. As soon as analyzer 60 determines that the oxygen concentration in the gas holder has been restored to a lower operating value, the electrical output signal from the analyzer falls below predetermined minimum operating values. Output signals, through the relays and electrical control circuits, activate compressor motor 36 and evaporative condenser water circulating motor 70. Subsequently, when oxygen concentrations reduce from 5.7 volume percent to 1.7 volume percent, control circuits cause solenoid valve 66 to close, and the normal mode of operation is restored.

A second oxygen analyzer 77 of similar construction is employed to monitor the oxygen concentration in the top of separator 52 because oxygen concentrations in piping 75 are greater than those beforehand by the amount of condensation that may occur. For this purpose analyzer 77 is shown as having a sampling connection 76 to piping 75 which conveys the uncondensed vapor and blanketing gas from separator 52.

If analyzer 77 detects an oxygen concentration in piping 75 on the order of 5.7% oxygen, the analyzer provides an output signal transmitted via electrical connections 73 and 65 to deactivate the motors driving the evaporative condenser and the compressor. When either analyzer 60 or 77 detects an oxygen concentration in the order of 5.7 volume percent, the resulting electric signal which de-energizes motors 36 and 70, servicing compressor 35 and condenser 50 respectively, will over-ride any signal from the gas holder diaphragm level switch 72 to energize these motors.

A dual pen integrating flow recorder FR,FR' of any suitable type is connected to monitor, separately, the quantity of blanketing gas entering the invention through piping 14 and the quantity of gas and vapor being delivered from the invention through piping 75. In this manner there is provided a continuous totalizing record of the quantity of vapor emissions recovered, that being the difference between the inhalations or use of, blanket gas and the net exhalations of the system. Thus, the difference in the integrated readings by recording pens FR,FR' represents the net uncondensed vapor recovered from tankage and the loading rack facilities. All condensed portions of the vapor recovered in separator 52 are returned to the storage tanks through piping 57 or to some other suitable liquid collection tanks. Experience has shown that the described system normally recovers substantially all of the vapor originating from the volatile liquid being stored or loaded.

LOADING RACK FACILITIES

The loading rack facilities, illustrated in the lower left hand corner of FIG. 1, comprise loading racks 80 for tank trucks and 81 for tank cars. The loading racks as shown are intended to apply to any truck, rail car, ship, or barge loading facility with conventional vapor recovery loading nozzles. Typically each loading rack includes liquid supply piping 82 from storage tanks 10,10 and a separate supply pipe 83 from the storage tank 11 connected through suitable control valves to the inlet of a loading rack supply pump 85 driven by motor 87. The outlet of this pump is typically connected by a manifold 86 at the loading facilities 80,81 by conventional auxiliaries. Pump motor 87 is typically started and stopped by manual control switch 88. As soon as the pump 85 starts the resulting flow of liquid to the loading racks will activate the flow sensing switch 96 and send a control signal to start operation of the compressor motor 36 and of the evaporative condenser motor 70, if these two motors are not then in operation. If they are in operation the control signal from flow switch 96 is unnecessary and redundant.

The loading rack filling nozzles are typically provided with vapor collection piping 90,91, equipped with check valves 95, and vapor collection header 92. The header 92 is equipped with a flame arrester 93 and is connected to the compressor by inlet piping 37. Each of the vapor collection pipes 90,91 is provided with a check valve 95 to prevent vapors displaced from one loading compartment to be admitted into another compartment and to prevent the entrance of blanketing gas into the compartments being filled. The blanketing gas is purged into the extremity of the collection header 92 so as to convey the vapor displaced from the compartments being filled to the compressor. As shown, the blanket purge gas is supplied from piping 67 via piping 93 equipped with a check valve 94 and a solenoid control valve 49A. Valve 49A is energized whenever the loading rack supply pump is in operation, such as by a flow responsive switch 96 which responds to the flow of liquid in piping 86 when pump 85 is operating.

During the loading period of any truck, rail car, ship, or barge, air trapped in the compartments being filled will flow with the displaced vapor into header 92 and mix with the blanket purge gas entering this header from supply piping 67,93. Samples of this gaseous mixture are continuously bled from header 92 via sampling connection 97 to the oxygen analyzer 98 via the three-way valve 99. If the oxygen concentration is in the order of 5.7% oxygen or higher by volume, analyzer 98 will provide an output signal that will sound the alarm 68 and activate the warning light 69, both located at the loading rack. If the attendant is not in the immediate vicinity of the loading rack, he will go to the rack to turn off the alarm. However, the warning light will remain on until the oxygen concentration is rectified.

Concurrently, a signal will be transmitted over connection 100 to deactivate the compressor motor 36 and the condenser motor 70, and to open solenoid valve 105 so that the gas mixture containing excess oxygen is vented to a safe place of disposal, such as a flare, not shown. Concurrently, the output signal from analyzer 98 is transmitted to and opens the solenoid valve 49B in parallel with the then open solenoid valve 49A. The combined flow capacities of the two open valves 49A and 49B provide an increased flow of blanketing gas in order to reduce the time required to dilute the oxygen concentration to acceptable limits.

The flow of the gas collected from the loading rack to a disposal flare does not include gas from holder 17 because the high pressure now prevailing on the outlet of the differential pressure valve 38 in pipe line 37 causes differential pressure transmitter 39 to close valve 38 and keep it closed until solenoid valve 105 to the flare recloses when analyzer 98 determines that the concentration of oxygen in line 92 is acceptable. When analyzer 98 detects an oxygen concentration in the order of 5.7 volume percent, the resulting electric signal which de-energizes motors 36 and 70, servicing compressor 35 and condenser 50 respectively, will over-ride any signal from the gas holder diaphragm level switch 72 to energize these motors.

Analyzer 77 is located in the system after condensations are removed because such removals increase oxygen concentrations in the gas phase. This analyzer backs up analyzers 60 and 98 by recording the percent oxygen volume in gases and vapors from both tankage and loading racks. Analyzer 77 is regulated to activate the alarm and control circuits when the oxygen concentration is one half of that of the upper explosive limit when the loading rack and tank facilities are combined.

SELF-CHECK FACILITY FOR OXYGEN ANALYZER

To safeguard against continuing to use an oxygen detection cell forming a critical component of the oxygen analyzers if defective or beyond its fully effective service life, each of the analyzers 60, 77 and 98 is provided with a timer-controlled solenoid-driven three-way valve and a compressor 107 operable to check the operating condition of the associated cell. Normally, the three-way valves 62, 78 and 99 are positioned as shown in full lines in FIG. 1 wherein they are effective to sample the vapor and gas mixture for the presence of oxygen. Periodically, such as once per hour, the timer T energizes the solenoid 102 driving the associated three-way valve to supply air from the atomsphere via piping 108 to the associated one of the oxygen analyzers 60, 77, or 98. This air is compressed by a continuously operating compressor 107 and circulated past the cell for a brief period, such as three minutes. If the analyzer determines the normal percentage of 21% oxygen of atmospheric air is present, it is known that the analyzer cell is functioning properly and no warning signal is given. At the end of the brief checking period timer T operates to restore the three-way valve 99 to its normal or former position wherein the analyzer checks the vapor and gas mixture for oxygen. If the cell finds that the ambient atmospheric air being tested contains less than the normal 21% of oxygen, the cell is not functioning properly and the analyzer automatically activates special alarms, not shown, which identify the analyzer at fault and the extent to which it is faulty. It will be understood that each of the analyzers 60, 77, 98 is equipped with the same self-analyzing facilities and that oxygen concentration set-points are adjustable. These facilities include recording strip charts and reset panel alarms which are typically located in a control house occupied by supervisory personnel.

The strip charts include a graphic recorder for displaying the percentage of oxygen detected by the oxygen sensitive cell. Once each hour a high pip representing approximately 21% oxygen found present in the ambient air is recorded. The remainder of the recording will reflect a very low oxygen content in the gas being analyzed. The recorder provides a graphic picture of operating conditions and inspires confidence in the reliability and safety of the entire volatile fluid handling facility. The compressor motor 107 and timer T for oxygen analyzer 98 are deactivated by electric circuit 65 while the loading rack charge pump 85 is not in operation, since the loading rack may not be in operation for extended periods. Oxygen analyzers 60 and 77 and their ancilliaries, on the other hand, are normally in constant service because net tankage breathing and working exhalations continuously occur.

All electrical and pneumatic instrumentation are designed for fail safe operation wherein the failure of the power or the air supply places instruments in a position such that vapor or blanketing gas is contained in a manner that prevents any admixture of air into it.

While the particular vapor recovery system for loading racks and storage tanks herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A vapor recovery system for a volatile liquid storage facility of the type having closed liquid storage means connected to means for maintaining the ullage thereof filled with a blanketing gas from a source of blanketing gas and including means for maintaining the blanketing gas pressure in said ullage within a predetermined pressure range, holding tank means connected to the ullage of said liquid storage means to receive a mixture of vapor and blanketing gas therefrom, oxygen analyzer means in communication with said last mentioned means operable to monitor and analyze said vapor and gas mixture for oxygen and including means to activate control means to supply additional blanketing gas to said mixture of vapor from said source of blanketing gas, blanketing gas and oxygen automatically upon detection of an oxygen content in said vapor and gas mixture in excess of a predetermined value.

2. A vapor recovery system as defined in claim 1 characterized in the provision of means connected to said holding tank means for receiving and processing said vapor and gas mixture to condense vapor therefrom and to separate said condensed vapor from the portions of said mixture which remain in uncondensed vapor phase.

3. A vapor recovery system as defined in claim 2 characterized in that said means for condensing vapor present in said vapor and gas mixture includes compressor means and heat exchanger means for condensing vapor present in said mixture.

4. A vapor recovery system as defined in claim 3 characterized in that said control means activatable by said oxygen analyzer means includes means for controlling the operation of said compressor means and said vapor condensing means dependent upon the oxygen content found by said analyzer means to be present in said mixture of vapor and blanketing gas.

5. A vapor recovery system as defined in claim 4 characterized in that said oxygen analyzer means includes means operable upon detection of oxygen in said vapor and gas mixture in excess of a first predetermined percentage to acknowledge said condition to operating personnel.

6. A vapor recovery system as defined in claim 5 characterized in that said oxygen analyzer means includes means operable upon detection of oxygen in said vapor and gas mixture in excess of a second and greater predetermined percentage to interrupt the operation of said compressor and said condensing means and to purge additional blanketing gas into said vapor and gas mixture thereby to lower the percentage of oxygen in said gaseous mixture.

7. A vapor recovery system as defined in claim 6 characterized in that said oxygen analyzer means includes means operable to reactivate said compressor and condenser means and resume processing of said gaseous mixture when said oxygen analyzer means determines that the percentage of oxygen in said gaseous mixture is less than said second predetermined percentage.

8. A vapor recovery system as defined in claim 3 characterized in the provision of sensing means at said holding tank means normally operable to activate and deactivate said vapor compressor and condensing means in response to the presence of predetermined respective higher and lower volumes of said vapor and gas mixture contained in said holding tank means.

9. A vapor recovery system as defined in claim 3 characterized in the provision of additional oxygen analyzer means operable to analyze condensed blanketing gas at said heat exchange means for the percentage of oxygen therein and including means for deactivating said compressor means so long as the detected oxygen content is above a predetermined value.

10. A vapor recovery system as defined in claim 2 characterized in the provision of means for conveying said uncondensed vapor and blanketing gas to a place of beneficial usage thereof after a portion of said vapors have been condensed and separated therefrom.

11. A vapor recovery system as defined in claim 1 characterized in that said oxygen analyzer means includes means for periodically utilizing said analyzer means for a brief interval to measure the percentage of oxygen in the ambient air and including alarm means automatically activatable if the detected percentage of oxygen in said ambient air varies more than a predetermined percentage from the normal oxygen content of atmospheric air.

12. In a vapor recovery system for a volatile liquid handling facility of the type having a plurality of volatile liquid storage tanks provided with means for maintaining the ullage thereof charged with blanketing gas and operatively connected to liquid loading rack means for mobile storage tanks and which system includes closed means for collecting vapor present therein including the ullage of said storage tanks and said loading rack means in blanketing gas and delivery the a mixture of said vapor and blanketing gas to vapor condensing and separator means, that improvement which comprises: oxygen analyzer means for monitoring a mixture of vapor and blanketing gas enroute from said loading rack means to said vapor condensing and separator means for the presence of oxygen and including means operable in response to the detection of oxygen in the mixture of vapor and blanketing gas flowing from said loading rack means in excess of a predetermined percentage to route said vapor and gas mixture around said vapor condensing and separator means and directly to a place of disposal.

13. That improvement in a vapor recovery system as defined in claim 12 characterized in that said oxygen analyzer means includes means for periodically utilizing said analyzer means for a brief interval to measure the percentage of oxygen in the ambient air and including alarm means automatically activatable if the detected percentage of oxygen in said ambient air varies more than a predetermined percentage from the normal oxygen content of atmospheric air.

14. That improvement in a vapor recovery system as defined in claim 12 characterized in that said oxygen analyzer means includes means responsive to the detection of excessive oxygen in said mixture of vapor and blanketing gas to activate alarm means to alert supervisory personnel that said analyzer means has detected the presence of excess oxygen in said vapor recovery system.

15. That improvement in a vapor recovery system as defined in claim 12 characterized in the provision of gas holding means connected to receive a mixture of vapor and blanketing gas from said plurality of volatile liquid storage tanks, said oxygen analyzer means including first and second oxygen analyzer means, said first analyzer means being in communication with and operable to analyze the contents of said gas holding means for oxygen and including means operable upon detecting an excessive percentage of oxygen to admit a diluting quantity of blanketing gas from a source of blanketing gas to the mixture of blanketing gas and vapor enroute to said gas holding means, and said second analyzer means being in communication with volatile vapor exiting from a mobile storage tank undergoing filling with volatile liquid at said loading rack means and including means operable to admit additional blanketing gas into the vapor exiting from said mobile tank in excess of the amount required to render said vapor non-combustible.

16. That improvement in a vapor recovery system defined in claim 12 characterized in the provision of means in said fluid handling means responsive to the flow of volatile liquid to a mobile tank undergoing filling at said loading rack means to initiate a flow of blanketing gas for admixture with captive volatile vapor exiting from said mobile tank.

17. That improvement in a vapor recovery system as defined in claim 16 characterized in that said oxygen analyzer means includes means for monitoring the mixture of vapor and blanketing gas enroute away from said loading rack means for the presence of oxygen in excess of a predetermined percentage and including alarm means automatically rendered active when said excess percentage of oxygen is detected thereby.

18. That improvement in a vapor recovery system as defined in claim 12 characterized in that said vapor condensing means for vapor collected from said loading rack means includes compressor means connected to condenser means operable to pressurize said vapor and blanketing gas and cooperating to compress and condense portions of said vapor into liquid for separation from said blanketing gas.

19. That improvement in a vapor recovery system as defined in claim 12 characterized in that said vapor condensing means for vapor collected from said loading rack means includes compressor means and condenser means cooperating to compress and condense a portion of said vapor into liquid, and said oxygen analyzer means including means operable upon detecting the presence of oxygen in excess of a predetermined percentage in the gas and vapor mixture enroute to said compressor means to deactivate said compressor and condenser means and to route said gas and vapor mixture to disposal means therefor.

20. A vapor recovery system for a volatile liquid handling system of the type having storage tank means for volatile liquid connected by liquid flow handling means to loading rack means for a mobile tank, that improvement which comprises: piping means for conveying vapor away from a mobile tank undergoing filling at said loading rack means, means for admitting a blanketing gas into said piping means conveying said vapor away from loading rack means, means responsive to the flow of liquid to said loading rack means through said liquid flow handling means for initiating the flow of blanketing gas into said piping means, and oxygen analyzer means connected to said piping means including means operable as vapor starts to flow through said piping means upon initiating a mobile tank filling cycle to detect the presence of an oxygen content in excess of a predetermined percentage and responsive thereto to activate alarm means to indicate this oxygen condition.

21. A vapor recovery system as defined in claim 20 characterized in the provision of compressor means for pressurizing said vapor and blanketing gas and having an inlet connected to said piping means and operable to condense vapor from said mixture of vapor and blanketing gas while a mobile tank is undergoing filling with said volatile liquid, and means connected to said oxygen analyzer means and responsive to the detection of an excessive percentage of oxygen in the gas and vapor undergoing pressurization to deactivate said compressor and to divert said vapor and gas mixture to disposal means therefor.

22. A vapor recovery system as defined in claim 20 characterized in that said oxygen analyzer means includes means operable upon the detection of an excessive percentage of oxygen in said vapor and gas mixture to increase the rate of flow of blanketing gas to said vapor and gas mixture thereby to dilute the percentage of oxygen therein.

23. A vapor recovery system as defined in claim 22 characterized in that said oxygen analyzer means including means automatically operable to terminate the supply of additional blanketing gas to said vapor and gas mixture as soon as said analyzer means determines the percentage of oxygen in said vapor and gas mixture is not in excess of said predetermined percentage.

24. A closed vapor recovery system for a volatile liquid handling facility having a plurality of closed tanks for storing different non-compatible volatile liquids, means for supplying blanketing gas to the ullage of each of said storage tanks, holding tank means connected to said storage tanks to receive a mixture of vapor and blanketing gas from each of said storage tanks and including valve means operable to safeguard against the flow of vapor into a storage tank containing a non-compatible liquid, and oxygen analyzer means in communication with said mixture of vapor and blanketing gas downstream from said storage tanks operable to monitor said vapor and gas mixture for the presence therein of oxygen in excess of a predetermined percentage and including means to supply additional blanketing gas to said vapor and gas mixture to dilute the percentage of oxygen therein.

25. A vapor recovery system as defined in claim 24 characterized in the provision of alarm means activatable by said oxygen analyzer means to alert supervisory personnel of the detection in said vapor recovery system of oxygen in excess of said predetermined percentage.

26. A vapor recovery system as defined in claim 24 characterized in the provision of compressor means connected to said holding tank means for compressing said vapor and gas mixture, and sensing means at said holding tank means for sensing the volume of vapor and gas mixture therein and responsive thereto to activate and deactivate said compressor means in response to changes in the volume of said vapor and gas mixture in said holding tank means.

27. A vapor recovery system as defined in claim 26 characterized in that said oxygen analyzer means includes means operable in response to the detection of said predetermined percentage of oxygen in said vapor and gas mixture to deactivate said compressor means until sufficient additional blanketing gas has been added thereto to reduce the percentage of the oxygen content to a predetermined value.

28. A vapor recovery system for a volatile liquid handling facility comprising: closed volatile liquid storage tank means equipped with normally closed pressure relief means and having the ullage thereof connected to means for maintaining said ullage charged with combustible blanketing gas, holding tank means connected to the ullage of said storage tank means, and oxygen analyzer means connected to said holding tank means operable to monitor a mixture of vapor and blanketing gas received by said holding tank means to determine the percentage of oxygen therein and including means controlled by said analyzer means to decrease said detected oxygen percentage by introducing additional blanketing gas to said mixture of vapor and blanketing gas only so long as the detected oxygen percentage in said mixture of vapor and blanketing gas remains above a predetermined value.

29. A vapor recovery system as defined in claim 28 characterized in the provision of means controlled by said analyzer means for venting blanketing gas containing excess oxygen to the atmosphere while adding supplemental blanketing gas to the mixture of vapor and blanketing gas flowing to said gas holding means from said storage tank means.

30. A vapor recovery system as defined in claim 28 characterized in the provision of oxygen analyzer means for sampling said pressurized gas mixture for oxygen before delivery thereof to a gas distribution system.

31. A closed vapor recovery system for a volatile liquid loading facility comprising: means for transfering volatile liquid from a source thereof into a mobile liquid container, piping means connecting said mobile container to gas and vapor compressor means, means for supplying blanketing gas to said piping means for flow to said compressor means along with vapor of said volatile liquid when ever as volatile liquid is being transfered to said liquid container, and means for conducting the compressed vapor and blanketing gas from said compressor means to a place of disposal.

32. A vapor recovery system as defined in claim 31 characterized in the provision of means connected to said piping means for detecting the presence therein of oxygen in excess of a predetermined percentage and including means automatically operable in response to the detection of excess oxygen to increase the flow of blanketing gas into said piping means.

33. A vapor recovery system for a volatile liquid handling system having storage tank means for volatile liquid connected by liquid flow handling means to loading rack means for filling a mobile tank, that improvement which comprises: piping means for conveying vapor from the interior of a mobile tank undergoing filling with volatile liquid at said loading rack means, means for purging a blanketing gas into said piping for admixture with vapor therein, holding tank means connected to the ullage of said storage tank means and to a source of said blanketing gas and operable to store blanketing gas and vapor received from the ullage of said storage tank means, compressor means connected to said holding tank means and to said piping means for compressing blanketing gas and vapor present therein and including pressure responsive means automatically operable to block flow of said purging gas and vapor to said holding tank means from said loading rack means while said loading rack means is in use to fill a mobile tank and operable at other times to pass blanketing gas and vapor from said holding tank means to said compressor means.

34. A closed vapor recovery system for a volatile liquid handling facility having first and second tanks for storing different non-compatible volatile liquids, means for supplying blanketing gas to the ullage of said storage tanks, holding tank means connected to said storage tanks to receive a mixture of vapor and blanketing gas from each of said storage tanks and including means for sensing the differential pressure, if any, between the separate mixtures of vapor and blanketing gas enroute to said holding tank means from said first and second tanks and operatively connected to valve means automatically operable to safeguard against the flow of vapor into said first storage tank from said second storage tank and permitting a flow of vapor and blanketing gas from both of said first and second tanks to said holding tank means so long as the pressure of the gas and vapor mixture exiting from said second storage tank does not exceed the pressure of the vapor and gas mixture exiting from said first storage tank means.

35. That improvement in a loading rack facility for transfering volatile liquid from a source thereof into a mobile transport such as tank trucks, tanker vessels, rail cars and the like, comprising: volatile liquid transfer means having nozzle discharge means having a close fit with the liquid inlet of a mobile transport and including header means for conveying volatile vapor away from the interior of the liquid compartment of a mobile transport undergoing filling with volatile liquid, normally closed means for introducing a blanketing gas into said header means closely adjacent said nozzle means for admixture with vapor discharging into said header from the mobile transport compartment undergoing filling, and means connected to said liquid transfer means automatically responsive to the supply of volatile liquid to a mobile transport compartment to initiate a supply of blanketing gas to said header from said sorce of blanketing gas and for maintaining said gas supply so long as liquid is flowing to a mobile transport.

36. That improvement defined in claim 35 characterized in the provision of oxygen analyzer means for monitoring the gas and vapor mixture in said header and including means for increasing the flow of blanketing gas from said sorce of blanketing gas to said header so long as said oxygen analyzer means detects the presence of oxygen in said header means in excess of a predetermined percentage.

37. That improvement defined in claim 36 characterized in the provision of compressor means connected to said header means for compressing said vapor and gas mixture and including control means operable in response to the detection by said oxygen analyzer means of the presence of oxygen in said vapor and gas mixture in excess of a predetermined percentage to deactivate said compressor means and to bypass said vapor and gas mixture to a place of disposal thereof.

38. That improvement defined in claim 35 characterized in the provision of compressor means connected to said header means for compressing said vapor and gas mixture.

* * * * *

UNITED STATES PATENT OFFICE

CERTIFICATE OF CORRECTION

Patent No. 4,098,303 Dated July 4, 1978

Inventor(s) Donald M. Gammell

It is certified that error appears in the above-identified patent and that said Letters Patent are hereby corrected as shown below:

Claim 12, Col. 11, line 61, after "connected" insert --by fluid handling means --.

Claim 12, Col. 11, line 65, "delivery" should be --delivering--.

Claim 20, Col. 13, line 30, after "oxygen" insert --excess--.

Claim 31, Col. 14, line 65, "when ever as" should be --whenever--

Claim 35, Col. 16, line 20, "said sorce" should be --a source--.

Claim 36, Col. 16, line 27, "sorce" should be --source--.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*